US005842425A

United States Patent [19]

van der Aa

[11] Patent Number: 5,842,425

[45] Date of Patent: Dec. 1, 1998

[54] TABLE ASSEMBLY

[76] Inventor: John van der Aa, 248 chemin de la Baie Claire, LaMacaza, Québec, Canada, J0T 1R0

[21] Appl. No.: 667,230

[22] Filed: Jun. 19, 1996

[51] Int. Cl.[6] ..... A47B 57/00

[52] U.S. Cl. ..... 108/64; 108/94; 108/103

[58] Field of Search ..... 108/64, 92, 189, 108/185, 93, 94, 103, 59, 139, 140; 297/141

[56] References Cited

U.S. PATENT DOCUMENTS

| | | | |
|---|---|---|---|
| 138,406 | 4/1873 | Johnson . | |
| 488,594 | 12/1892 | Yost | 108/103 |
| 1,701,930 | 2/1929 | Muller . | |
| 2,943,902 | 7/1960 | McMechen . | |
| 3,002,787 | 10/1961 | Ziegenfuss . | |
| 3,538,862 | 11/1970 | Patriarca | 108/94 X |
| 3,789,778 | 2/1974 | Brand | 108/101 X |
| 3,955,850 | 5/1976 | Toso . | |
| 4,223,613 | 9/1980 | Yoshizawa . | |
| 5,035,186 | 7/1991 | Uredat et al. . | |
| 5,438,937 | 8/1995 | Ball et al. . | |

FOREIGN PATENT DOCUMENTS

| | | | |
|---|---|---|---|
| 1463176 | 12/1966 | France | 108/64 |
| 510286 | 1/1955 | Italy | 108/64 |
| 675816 | 11/1990 | Switzerland | 108/64 |

*Primary Examiner*—Peter M. Cuomo
*Assistant Examiner*—Janet M. Wilkens
*Attorney, Agent, or Firm*—Swabey Ogilvy Renault

[57] ABSTRACT

There are provided a plurality of main tables associated with at least one side table which is pivotably connected to two main tables. In storage position the side table is at least partly stored underneath one main table, while in use it is pivotably extended and connected to two main tables.

12 Claims, 4 Drawing Sheets

TABLE ASSEMBLY

BACKGROUND OF THE INVENTION (a) Field of the Invention

The present invention relates to tables. More particularly, the invention relates to a table assembly having a connection device for connecting to another table, particularly through small side tables.

(b) Description of Prior Art

Tables which interconnect to one another are known in the art, as for example, those which are described in U.S. Pat. Nos. 5,035,186 and 5,438,937. In the '186 Patent granted to Uredat et al., a pivotable support element can be turned outward from a main table to support another table surface connected thereto. The tables connected in this way would form simply a rectilinear configuration. In the '937 Patent granted to Ball et al., a mobile table assembly has a number of table members which can be interconnected about a central post in such a way that the assembly can make up a round table configuration based on a single post or a table may interconnect to posts to form a chain of tables for a larger assembly. Table assemblies which have pivoting side table surfaces are known from U.S. Pat. Nos. 138,406 and 2,943,902. In the '406 Patent, the side table is pivotally mounted to a leg of a main table and is much lower than the main table surface. The side table can be used for placing a teapot or stack of extra plates and is provided with a caster wheel base for moving in and out. The table assembly in the '902 Patent has four swing out isosceles triangular members pivotally connected to each corner of the table for converting the table from a bridge table to a poker table top.

In known table assemblies, a variety of arrangements in interconnected tables to provide a table system suitable for a particular social occasion or working environment by providing a particular table system configuration is not possible.

SUMMARY OF THE INVENTION

It is an object of the present invention to provide a table assembly which permits a plurality of tables to be pivotally interconnected in a variety of configurations.

According to the invention, there is provided a table assembly comprising a main table member and a side table, and first connecting means for pivotally connecting the side table to the main table member to pivot between a storage position in which the side table is stored at least partly underneath the main table member, and an extended position in which the side table is pivotably extended to a side of the main table member and is at least partly accessible for use. Second connecting means are provided for connecting the side table to another main table. In this way, the table assembly can be interconnected through the second connecting means to at least one other main table to provide an arrangement of tables in a desired configuration. Preferably, the second connecting means connect the side table to the other main table in a pivotable fashion to improve the angular arrangement between the two connected main tables. Also preferably, the main table member is on caster rollers to facilitate rearrangement of the table assembly.

BRIEF DESCRIPTION OF THE DRAWINGS

The invention will be better understood by way of the following detailed description of a preferred embodiment with reference to the appended drawings in which.

DESCRIPTION OF PREFERRED EMBODIMENTS

Figure 1:
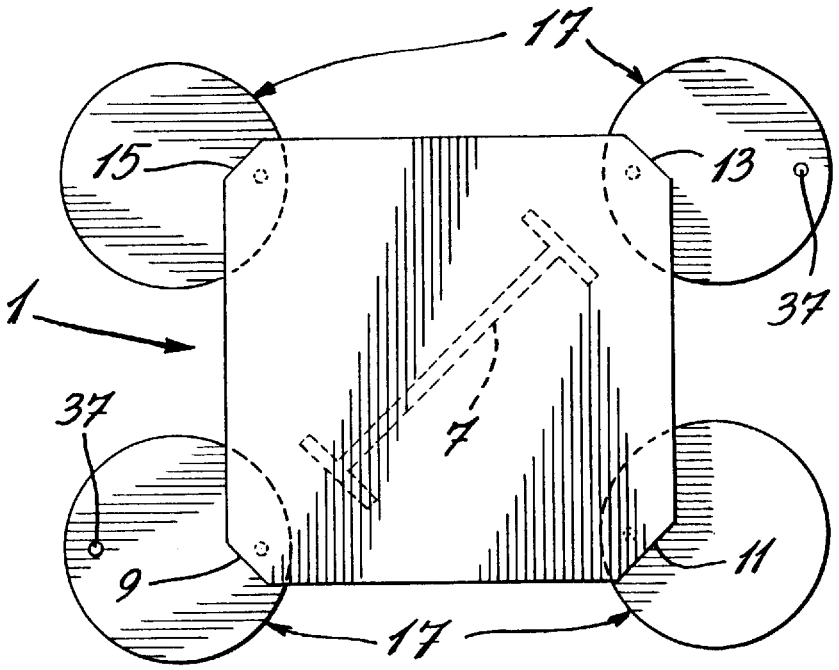
FIG. 1 is a top view of a table assembly including a rectangular main table member and side tables interconnected at the four corners thereof.
Figure 2:
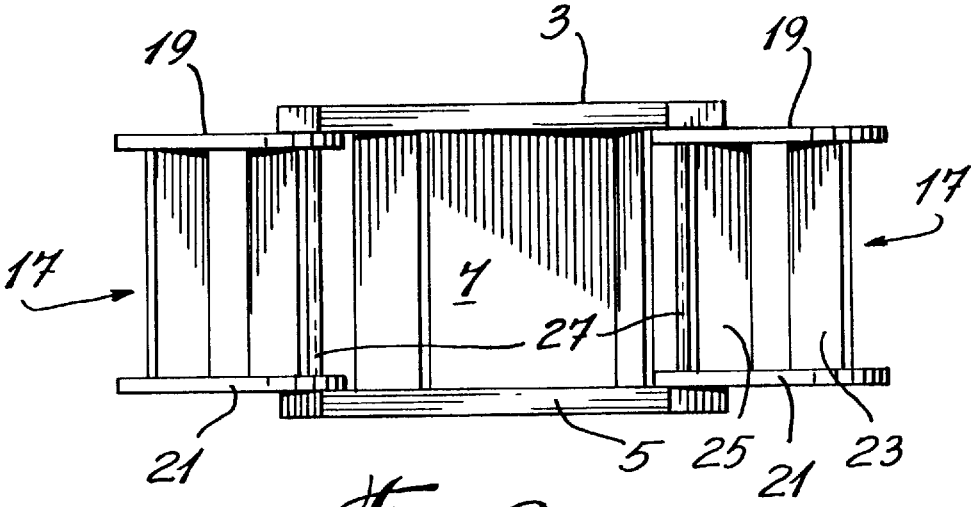
FIG. 2 is a detailed side view illustrating the assembly of FIG. 1.
Figure 4:
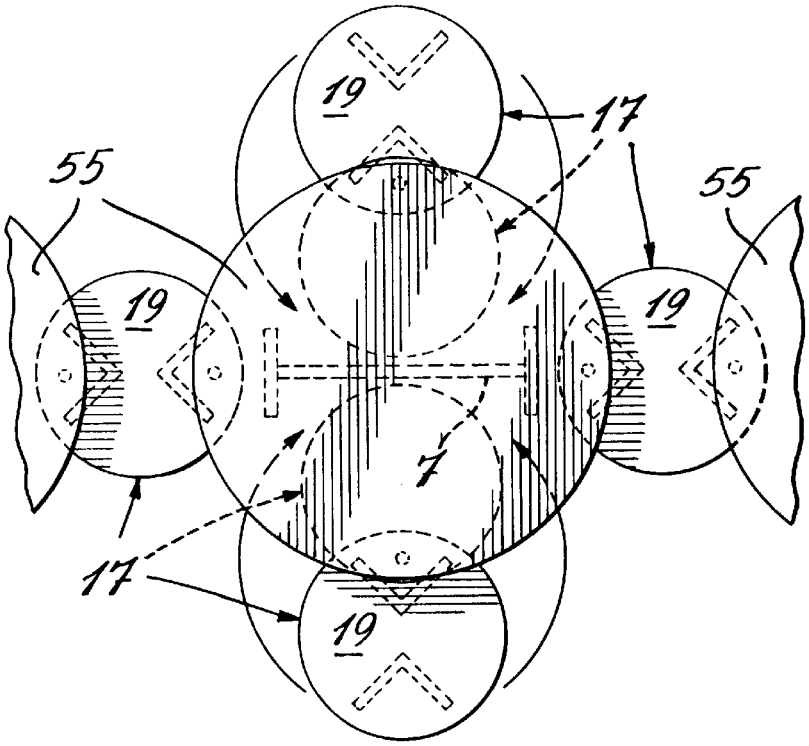
FIG. 4 is a top view of a table assembly showing a main round table member having four side tables interconnected thereto, two of the latter being interconnected respectively to two additional main round table members.
Figure 5:
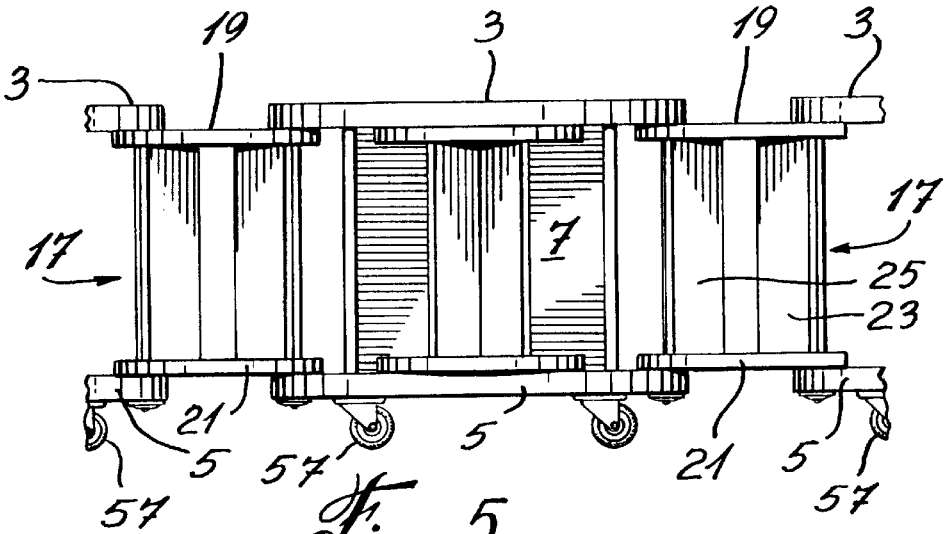
FIG. 5 is a detailed side view illustrating the assembly of FIG. 4 and showing details of the connection of side tables to the main table members and to the additional table members.

With reference to the drawings, it will be seen that a table assembly according to the invention may include different combinations of main table members and side table members interconnected thereto. A rectangular table member may, for example, be interconnected to four round side table members at the four corners thereof, as shown in FIGS. 1 and 2. Another possibility is to interconnect a round table member with four round side table members at 90° and to interconnect two of the diametrically opposed side table members respectively to two main additional round table members, as shown in FIGS. 4 and 5.

Figure 6:
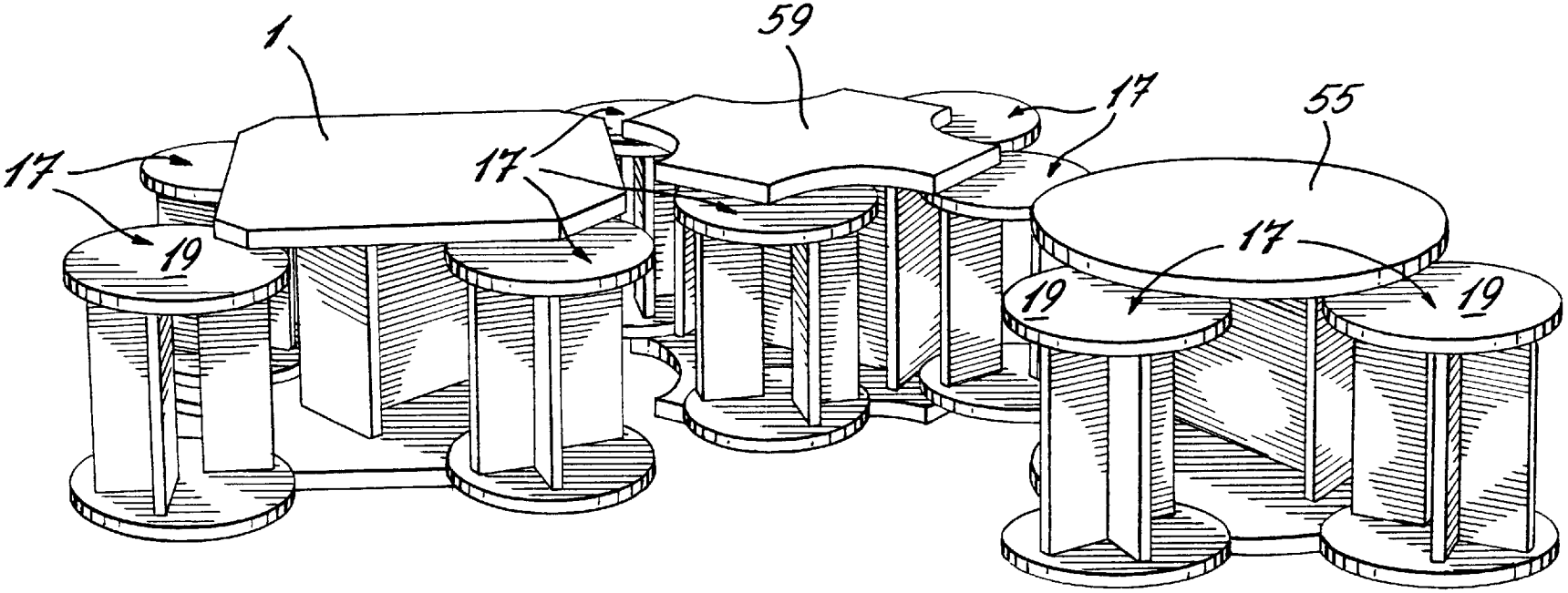
FIG. 6 is a perspective view of a table assembly according to another preferred embodiment in which three interconnected table assemblies are illustrated.

Still another possibility is to interconnect two different main rectangular table members and one main round table members by means of a plurality of side table members, as shown in FIG. 6. Other possibilities will, of course, appear obvious to one skilled in the art, and have not been illustrated in the drawings, as possibilities are unlimited.

For easy understanding of the invention, reference will first be made to the embodiment illustrated in FIGS. 1 and 2. It will be seen that main table 1 consists of a table top 3 and a table base 5 which are held together by means of a holding connection 7 which is in the form of a wide H. The top edge of H connection 7 is fixed in known manner to the underface of table top 3, while the lower edge thereof is fixed in the same manner against the upper face of table base 5. In this particular embodiment, both table top 3 and table base 5 are rectangular and preferably have the same shape. The top and the base are both cut out at the four corners as indicated by reference numerals 9, 11, 13 and 15 to make the table more practical. Of course, any other practical shape can be used without departing from the invention.

Referring again to FIGS. 1 and 2, four side tables 17 are provided to pivot respectively at the corners of the main table. As shown in FIG. 2, each side table 17 is designed to fit between table top 3 and table base 5. More particularly, each side table 17 comprises a side table top 19 and a side table base 21 both held together by means of a pair of V-shaped connecting members 23 and 25. Other connections are, of course, possible as will be known to those skilled in the art. As for the case of main table 1, the upper edges of V-shaped connecting members 23 and 25 are fixed in known manner to the underface of side table top 19 while the lower edges are fixed in known manner to the upper face of side table base 21. To constitute the pivots at the four corners, there is provided in the main table a pivot post 27 for each side table 17 (four such posts in the present embodiment), which is fixed relative to table top 3 and table base 5, as will be explained more in detail later. Side table top 19 and side table base 21 are arranged so that pivot post 27 extends therethrough so as to allow side table 17 to pivot about post 27 relative to main table 1.

Figure 3:
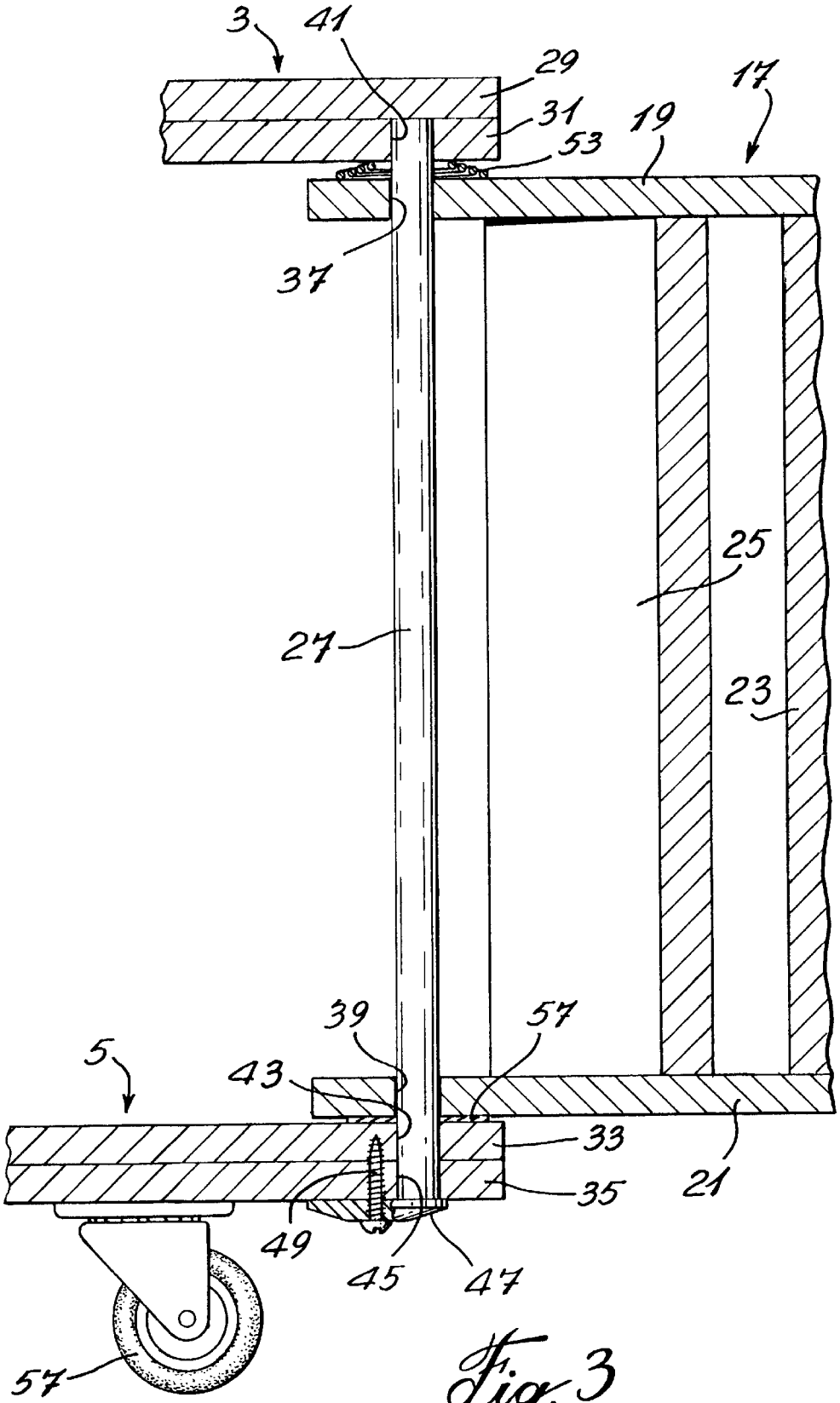
FIG. 3 is a cross-section view showing the pivotal interconnection between a main table member and a side table.

For more details of the pivot mounting of side table 17 on main table 1, reference will be made to FIG. 3. It will be seen that in practice main table top 3 and main table base 5 are each made of two plies, respectively 29, 31 for main table top 3 and 33, 35 for main table base 5. As shown, a circular hole 37 is provided in side table top 19 and another similar hole 39 is provided in side table base 21. In addition, aligned with holes 37 and 39, a hole 41 is formed in ply 31 of main table top 3 and consecutive holes 43, 45 are respectively formed in plies 33 and 35 of main table base 5. Post 27 is fixedly mounted in known manner in hole 41 and is also fixed with respect to main table base 5. To achieve this the lower end of post 27 is fixed in known manner in cap 47 which is screwed against the underface of table base 5 through both plies 33 and 35 by means of screw 49. Of course, post 27 is freely mounted through holes 37, 39 to enable side table 17 to pivot about post 27, the latter being fixed. To facilitate this pivoting movement a washer 51 is disposed between side table base 21 and table base 5, as particularly shown in FIG. 3. Of course, washer 5 is made of a material such as Teflon® which has a very low friction coefficient.

Finally, in order to prevent free swinging of side tables 17 especially when they are not connected to still another main table as is the case for the embodiments illustrated in FIGS. 1 and 2, there is provided a coil spring 53 which is mounted around post 27 and is disposed between the underface of main table top 3 and the upper face of side table 17. In this manner, just enough pressure is exerted between main table top 2 and side table top 19 to prevent free rotation of side table 17 relative to main Table 3.

The invention has been described with reference to a rectangular main table 1 which is interconnected with four round side tables 17, as shown in FIGS. 1 and 2.

Another arrangement is shown is FIGS. 4 and 5 wherein a round main table 55 is interconnected with four round side tables 17 and is further connected to two additional round main tables 55 via two diagonally arranged side tables 17.

Of course, since these tables are intended to be moved according to a predetermined arrangement, casters 57 are mounted in known manner underneath main table bases, as shown in FIG. 5.

Yet another possible arrangement is the one illustrated in FIG. 6. There is here shown a combination of three main tables, i.e., rectangular table 1, round table 55 and cross-like table 59 all interconnected with three or more side tables 17.

Although the invention has been described with reference to preferred embodiments, it is understood that modifications may be made without departing from the spirit and scope of the appended claims.

I claim:

1. A table assembly comprising;

a first main table member including a main table top;

a side table having a side table top;

first connecting means for pivotably connecting said side table to said main table member with said side table top parallel and below said main table top to pivot about a vertical axis and to provide a substantially continuous table top surface over said main table top and said side table top, wherein said first connecting means are provided below said main table top, said main table top being unobstructed by said first connecting means; and second connecting means provided on said side table for connecting said side table to a second main table member, whereby said table assembly can provide an arrangement of tables in a desired configuration.

2. The table assembly as claimed in claim 1, wherein said second connecting means connect pivotably to a second main table member.

3. The table assembly as claimed in claim 2, wherein said first main table member is supported on caster rollers.

4. The table assembly as claimed in claim 3, wherein said side table is round.

5. The table assembly as claimed in claim 1, wherein said first connecting means and said second connecting means are identical.

6. The table assembly as claimed in claim 1, wherein two said side tables are provided, said side tables being opposite one another.

7. The table assembly as claimed in claim 1, wherein said main table member has a main table base, said side table is mounted below said main table top and above said main table base, said second connecting means being located on said side table diametrically opposite to a line of pivot and a center of said side table.

8. The table assembly according to claim 7, wherein said first connecting means comprises a pivot post fixedly disposed between said main table top and table base, said side table having means enabling same to pivot about said pivot post.

9. The table assembly as claimed in claim 7, wherein said main table top is rectangular, said side table is mounted at a corner of said main table member.

10. The table assembly as claimed in claim 1, wherein said main table member is supported on caster rollers.

11. A table assembly comprising:

a first main table member including a main table top;

a side table having a side table top;

first connecting means for pivotably connecting said side table to said main table member with said side table top parallel and vertically adjacent to said main table top to pivot about a vertical axis; and second connecting means provided on said side table for connecting said side table to a second main table member, wherein:

said main table member has a main table base, said side table is mounted below said main table top and above said main table base, said second connecting means being located on said side table diametrically opposite to a line of pivot and a center of said side table; and wherein said side table has a side table base, said side table top and said side table base being connected together and adapted to fit between said main table top and said main table base of at least one main table member to which it is interconnected.

12. The table assembly according to claim 8, which comprises pivot holes provided in said side table top and said table base, a pivot post extending through said pivot holes to permit pivoting of said side table relative to said main table member.

* * * * *